United States Patent [19]

Binversie et al.

[11] Patent Number: 5,030,147

[45] Date of Patent: Jul. 9, 1991

[54] IN-TRIMMING HYDRAULIC CIRCUIT

[75] Inventors: Gregory J. Binversie; David C. Calamia, both of Grayslake, Ill.

[73] Assignee: Outboard Marine Corporation, Waukegan, Ill.

[21] Appl. No.: 475,982

[22] Filed: Feb. 6, 1990

[51] Int. Cl.[5] ..... B63H 5/12

[52] U.S. Cl. ..... 440/61; 114/150

[58] Field of Search ..... 440/61; 91/420; 114/150; 137/112

[56] References Cited

U.S. PATENT DOCUMENTS

| | | | |
|---|---|---|---|
| 698,483 | 4/1902 | Faith et al. | 137/112 |
| 4,064,824 | 12/1977 | Hall | 440/61 |
| 4,096,820 | 6/1978 | Hall | 440/61 |
| 4,687,449 | 8/1987 | Fenrich | 440/61 |
| 4,702,714 | 10/1987 | Nakase | 440/61 |
| 4,781,631 | 11/1988 | Uchida et al. | 440/61 |

FOREIGN PATENT DOCUMENTS

| | | | |
|---|---|---|---|
| 1282381 | 7/1972 | United Kingdom | 91/420 |

*Primary Examiner*—Sherman Basinger

*Attorney, Agent, or Firm*—Michael, Best & Friedrich

[57] ABSTRACT

Disclosed herein is a hydraulic circuit for a marine propulsion device, which circuit comprises a sump for hydraulic fluid, a reversible hydraulic pump, a first fluid conduit communicating between the sump and the pump and including a one way check valve permitting flow to the pump from the sump and preventing flow to the sump from the pump, a second fluid conduit communicating between the sump and the pump and including a one way check valve permitting flow to the pump from the sump and preventing flow to the sump from the pump, and a mechanism for opening one of the check valves in response to closure of the other of the check valves.

12 Claims, 1 Drawing Sheet

IN-TRIMMING HYDRAULIC CIRCUIT

RELATED PATENTS

Attention is directed to application Ser. No. 451,629 filed Dec. 18,1989, and entitled Marine Propulsion Device.

BACKGROUND OF THE INVENTION

1. Field of the Invention

The invention relates generally to marine propulsion devices such as outboard motors and stern drive units. More particularly, the invention relates to hydraulic trim and tilt mechanisms for vertically raising and lower the propulsion units of such marine propulsion devices. Still more particularly, the invention relates to hydraulic circuitry for such hydraulic trim and tilt mechanisms.

2. Reference to the Prior Art

In the past, because of the presence of a piston rod within a hydraulic cylinder, a given amount of piston movement resulted in a greater inflow or outflow at the non-piston rod end of the cylinder as compared to the inflow or outflow at the piston rod end of the cylinder.

In prior hydraulic circuits, the pump operated to supply hydraulic oil under pressure to the rod end of the cylinder during down or in-trimming. However, some of the hydraulic oil discharged from the pump was returned through a pressure relief valve to the sump because, for a given amount of piston movement, the flow from the non-piston rod end of the trim cylinder was greater than the flow to the piston rod end of the trim cylinder. Thus, not all of the oil under pressure discharged from the pump was used for in-trimming with the result that a longer time duration occurred during in-trimming than would have resulted if all of the hydraulic fluid leaving the pump was supplied to the rod end of the cylinder. Such slowness in action enhanced the possibility of the propulsion unit driving down and hitting or striking the piston rod because of the slowness of the in-trimming operation.

Attention is directed to the following U.S. Pat Nos:

| | | |
|---|---|---|
| 4,064,824 | Hall, et al. | December 27, 1977 |
| 4,096,820 | C. B. Hall | June 27, 1978 |
| 4,687,449 | W. G. Fenrich | August 18, 1987 |
| 4,781,632 | Uchida, et al. | November 1, 1988 |

SUMMARY OF THE INVENTION

The invention provides a hydraulic circuit for a marine propulsion device, which circuit comprises a sump for hydraulic fluid, a reversible hydraulic pump, a first fluid conduit communicating between the sump and the pump and including a one way check valve permitting flow to the pump from the sump and preventing flow to the sump from the pump, a second fluid conduit communicating between the sump and the pump and including a one way check valve permitting flow to the pump from the sump and preventing flow to the sump from the pump, and means for opening one of the check valves in response to closure of the other of the check valves.

The invention also provides a hydraulic circuit for a marine propulsion device including a cylinder/piston assembly including a blind end and a rod end, which circuit comprises a sump for hydraulic fluid, a reversible hydraulic pump including first and second discharge ports, a first fluid conduit communicating between the sump and the first discharge port of the pump and including a one way check valve permitting flow to the pump from the sump and preventing flow to the sump from the pump, and adapted to communicate with the blind end of the hydraulic cylinder/piston assembly, a second fluid conduit communicating between the sump and the second discharge port of the pump and including a one way check valve permitting flow to the pump from the sump and preventing flow to the sump from the pump, and adapted to communicate with the rod end of the cylinder/piston assembly, and means for opening the check valve in one of the fluid conduits in response to closure of the check valve in the other of the fluid conduits.

The invention also includes a marine propulsion device comprising a propulsion unit including an engine and a propeller shaft driven by the engine and adapted to support a propeller, means adapted for supporting the propulsion unit and including a first bracket adapted to be mounted on a boat transom, a second bracket connected to the first bracket for tilting movement about a horizontal axis and connected to the propulsion unit to afford common vertical tilting movement of the propulsion unit with the second bracket, a hydraulic cylinder/piston assembly including a cylinder having a blind end connected to the first bracket and a closed outer end, a piston located in the cylinder, and a piston rod fixed to the piston, extending through the closed end, and adapted to engage the second bracket, means for pressuring the cylinder to trim out and to trim in the propulsion unit and including a hydraulic sump, a reversible hydraulic pump including first and second discharge ports, a first fluid conduit including a first branch connecting the first discharge port of the pump to the closed end of the cylinder and a second branch connecting the first discharge port of the pump to the sump and including a one way check valve for permitting flow to the pump from the sump and for preventing flow from the pump to the sump, a second fluid conduit including a first branch connecting the second discharge port of the pump to the outer end of the cylinder and a second branch connecting the second discharge port of the pump to the sump and including a one way check valve for permitting flow to the pump from the sump and preventing flow to the sump from the pump, and means for opening the check valve in the second branch of one of the conduits in response to closure of the check valve in the second branch of the other of conduits.

Other features and advantages of the invention will become apparent to those skilled in the art upon review of the following detailed description, claims, and drawings.

Figure 2:
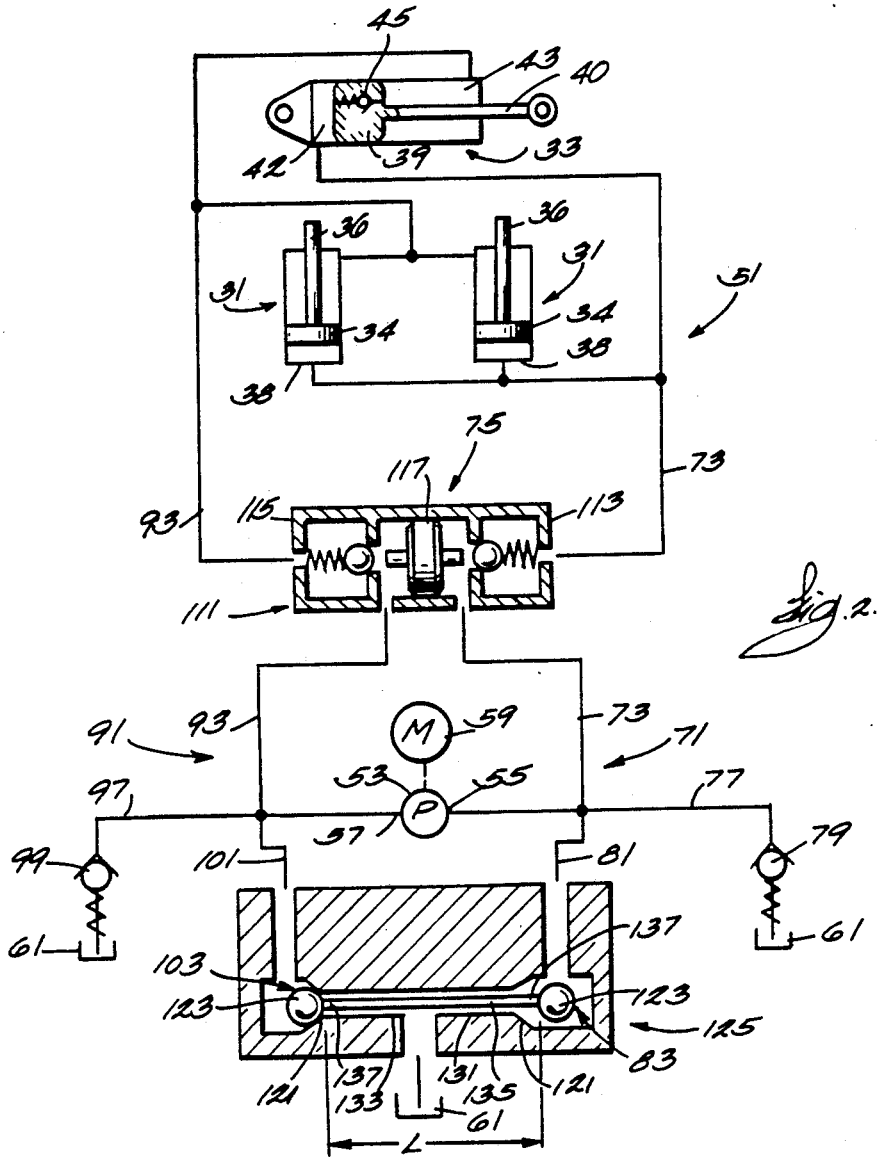
FIG. 2 is a schematic view illustrating a hydraulic system embodied in the marine propulsion device shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 1:
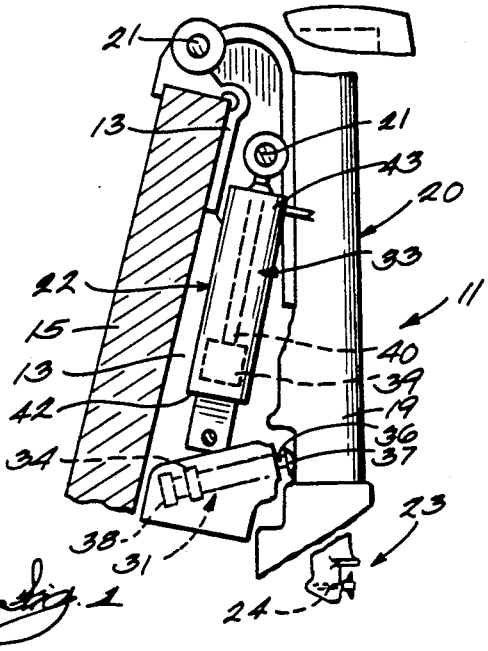
FIG. 1 is a side elevational view, partly in section, of a portion of a marine propulsion device incorporating various of the features of the invention.

FIG. 1 schematically illustrates a marine propulsion device in the form of an outboard motor 11 which includes a mounting or transom bracket 13 adapted to be attached in any suitable manner to the transom or hull of a boat 15. The motor 11 may be pivotally connected to the transom bracket 13 in any suitable manner, such as, by means of a swivel bracket 19 which is pivotally connected to the mounting bracket 13 by a generally horizontally extending tilt pin 21 and which is connected to a propulsion unit 20. A trim and tilt system 22 is connected to the propulsion unit 20 and is operative to pivot the propulsion unit 20 about the pin 21. It will be appreciated by those skilled in the art that the propulsion unit 20 includes an internal combustion engine (not shown) which is coupled by an output shaft and drive train (not shown) to a rotatably mounted propeller shaft 24 carrying a propeller 23.

The trim and tilt system 22 includes one or more trim cylinder/piston assemblies 31 and one or more tilt cylinder/piston assemblies 33. The trim cylinder/piston assemblies 31 are fixedly mounted at the blind or closed cylinder end thereof on the mounting bracket 13 and each includes a piston 34 movable therein and connected to a piston rod or stem 36 which extends through a closure cap closing the outer cylinder end and which has a rounded head 37 for bearing against the lower end of the swivel bracket 19. It will be appreciated that when the trim cylinder/piston assemblies 31 are pressurized at their lower or blind ends 38, the propulsion unit 20 will be trimmed upwardly about tilt pin 21, i.e., in a counterclockwise direction as viewed in FIG. 1.

The tilt cylinder/piston assemblies 33 are pivotally connected at their lower or blind ends to the mounting bracket 13 and, at their upper ends, to the swivel bracket 19 so that pressurization of the lower ends of the tilt cylinders will cause the propulsion unit 20 to tilt upwardly, i.e., in a counterclockwise direction as viewed in FIG. 1. Because the stroke of the tilt cylinder/piston assemblies 33 exceeds that of the trim cylinder/piston assemblies 31, both the trim and tilt cylinder piston assemblies 31 and 33 will be employed when the propulsion unit 20 is being trimmed. On the other hand, when the trim cylinder/piston assemblies 31 and 33 have reached the maximum extent of their stroke, further pivotal movement will be under the operation of the tilt cylinder/piston assemblies 33.

The tilt cylinder/piston assemblies 33 also include a piston 39 having a rod or stem 40 which is pivotally connected at its upper end to the swivel bracket 19. It will be appreciated that when the lower ends 42 of the tilt cylinder/piston assemblies 33 are pressurized, the pistons 39 will move toward the other or outer end 43 of tilt cylinder/piston assemblies 33 whereby the propulsion unit 20 will be pivoted in the upward or counterclockwise direction about the tilt pin 21 as shown in FIG. 1, while pressurization of the other or outer end 43 will pivot the propulsion unit 20 in the opposite or downward direction.

A one-way valve 45 (see FIG. 2) is located in each of the pistons 39 and prevents fluid flow from the lower cylinder end 42 to the upper cylinder end 43, but permits flow in the opposite direction. While the valve 45 may take any conventional form, in the illustrated embodiment it comprises a spring biased ball check valve. Valve 45 permits the tilt cylinder/piston assemblies 33 to extend rapidly as fluid flows from the upper end 43 to the lower end 42 in the event the propulsion unit 20 impacts an underwater obstacle. The bias on the valve 45 is relatively high, for example, about 2500 lbs./sq. in.

The marine propulsion device 11 also includes (see FIG. 2) a hydraulic circuit 51 for pressuring the trim and tilt cylinder/piston assemblies 31 and 33. While other constructions can be employed, in the disclosed construction, such means comprises a reversible hydraulic pump 53 which includes first and second discharge ports 55 and 57 and which is driven by a reversible electric motor 59 so that, depending upon the direction of rotation of the motor 59, one of the first and second ports 55 and 57 is pressurized.

The hydraulic circuit 51 also includes a sump 61 which supplies hydraulic fluid to the hydraulic circuit and receives hydraulic fluid from the circuit.

The hydraulic circuit 51 further includes a first fluid conduit 71 which communicates with the first discharge port 55 and which includes a first branch 73 which communicates between the first discharge port 55 and, through a control valve 75, with the closed or non-rod ends 38 and 42 of the trim and tilt cylinder/piston assemblies 31 and 33. The first fluid conduit 71 also includes a second branch 77 which communicates between the first discharge port 55 and the sump 61 and which includes a normally closed pressure relief valve 79 which normally prevents fluid flow to the sump 61 but which is operable, in the event of excessive pressure, to permit fluid flow to the sump 61.

Still further in addition, the first fluid conduit 71 also includes a third branch 81 which communicates between the first discharge port 55 and the sump 61 and which includes a check valve 83 preventing flow from the pump 53 to the sump 61 and permitting flow from the sump 61 to the pump 53.

The hydraulic circuit 51 also includes a second fluid conduit 91 which communicates with the second discharge port 57 and which includes a first branch 93 which communicates between the second discharge port 57 and, through the control valve 75, with the rod ends of the trim and tilt cylinder/piston assemblies 31 and 33. The second fluid conduit 91 further includes a second branch 97 which communicates between the pump discharge port 57 and the sump 61 and which includes a normally closed pressure relief valve 99 which normally prevents fluid flow to the sump 61 but which is operable, in the event of excessive pressure, to permit fluid flow to the sump 61. The second fluid conduit 91 also includes a third branch 101 which communicates between the second pump discharge port 57 and the sump 61 and which includes a check valve 103 normally preventing flow from the pump 53 to the sump 61 while permitting flow from the sump 61 to the pump 53.

The control valve 75 includes a housing or cylinder 111 which has opposing first and second ends 113 and 115 respectively communicating with the discharge ports 55 and 57. Disposed within the housing 111 is a control piston 117 which is mounted for movement from a center position toward the end 115 when the first end 113 of the cylinder 111 is pressurized from discharge port 55. Conversely, when the end 115 of cylinder 111 is pressurized through the discharge port 57, the piston 117 will move toward the end 113 of the cylinder or housing 111.

While other constructions can be employed, in the disclosed construction, each of the check valves 83 and 103 includes a valve seat 121 and a ball 123 movable relative to the valve seat 121.

As thus far disclosed, the construction is conventional.

The disclosed hydraulic circuit 51 additionally includes means 125 for opening one of the first and second check valves 83 and 103 in response to closure of other of the first and second check valves 83 and 103. As a consequence, when the pump 53 is operating to pressurize the second discharge port 57, and thus supply hydraulic fluid to the rod ends of the trim and tilt cylinder/piston assemblies 31 and 33, the check valve 103 is pressurized to its closed position. However, as it is desirable to employ the entire output of the pump for in-trimming, and as for any given piston movement, more oil must flow from the blind or closed non-rod end of the trim cylinder/piston assemblies 31 as compared to the rod end of the trim cylinder/piston assemblies 33, there is unbalanced flow between the inflow and the outflow. In the past, the excess flow in the second fluid line or conduit 91, as compared to the out flow in the first fluid line 71 from the closed or blind or non-rod ends 38 and 42 of the trim and tilt cylinder/piston assemblies 31 and 31, was dumped or drained to the sump 61 through the pressure relief valve 99. Thus, not all of the output from the pump 53 was used for in-trimming, thereby increasing the time interval during which in-trimming occurred. Accordingly, the hydraulic circuit 51 includes the aforementioned means for opening one of the first and second check valves 83 and 103 in response to closure of the other of the first or second check valves 83 and 103.

While various mechanical and hydraulic constructions can be employed, in the construction shown in FIG. 2, the third branches 81 and 101 of the first and second fluid conduits 71 and 91 respectively include portions 131 and 133 which are axially aligned and which slideably receive a push rod or member 135 which has opposed ends 137 respectively engaging with the balls 123 of the check valves 83 and 103 and has a length "L" such that closure of one of the check valves 83 and 103 necessitates opening of the other of the check valves 83 and 103.

As a consequence, when the second pump discharge port 57 is pressurized, pressure fluid causes the ball 123 of the second check valve 103 to move to the closed position, i.e., to seat against the valve seat 121. Such movement, in turn, causes slidable displacement of the push rod 135 through the aligned portions 131 and 133 of the third branches 81 and 101 of the first and second conduits 71 and 91 and opens the check valve 83 to insure a drainage path for the excess amount of oil leaving the non-rod ends 38 of the trim cylinder/piston assemblies 31 as compared to the quantity of oil entering the rod ends of the trim cylinder/piston assemblies 31. As a further consequence, the full discharge of the pump 53 is employed to quickly effect in-trimming of the piston rod 36.

Figure 3:
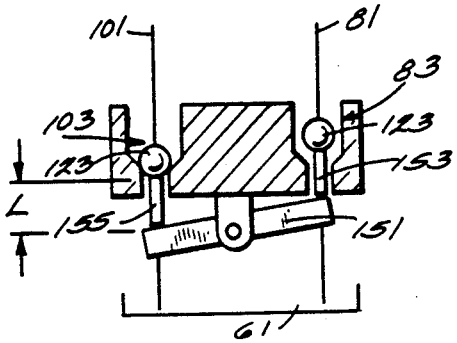
FIG. 3 is a fragmentary view of a second embodiment of a portion of the hydraulic circuit shown in FIG. 2.

Shown in FIG. 3 is a second embodiment of a mechanism for causing opening of one of the check valves 83 and 103 in response to closing of the other of the check valves 83 and 103. In the mechanism shown in FIG. 3, a rocker arm 151 is suitably supported intermediate the ends thereof, which ends are respectively in engagement with push rods or members 153 and 155 which enter into the third branches 81 and 101 of the first and second fluid conduits 71 and 91 for engagement with the balls 123 of the check valves 83 and 103 and which have a length "L" such that seating of one of the balls 123 to close the associated check valve 83 and 103 in response to discharge pump pressure causes rocking of the arm 151 to effect displacement of the other ball 123 from its seat, i.e., to effect opening of the other one of the check valves 83 and 103. Thus this arrangement serves to seat the ball 123 in the second fluid conduit 91 to prevent flow of pressure fluid from the pump 53 to the sump 61 during in-trimming and also acts to insure a flow path past the check valve 83 when the pump discharge port 57 is pressurized, thus facilitating full use of the hydraulic fluid discharged from the port 57 to effect in-trimming.

Various of the features of the invention are set forth in the following claims.

We claim:

1. A hydraulic circuit for a marine propulsion device, said circuit comprising a sump for hydraulic fluid, a reversible hydraulic pump, a first fluid conduit communicating between said sump and said pump and including a one way check valve permitting flow to said pump from said sump and preventing flow to said sump from said pump, a second fluid conduit communicating between said sump and said pump and including a one way check valve permitting flow to said pump from said sump and preventing flow to said sump from said pump, and means for opening one of said check valves in response to closure of the other of said check valves.

2. A hydraulic circuit in accordance with claim 1 wherein said first and second conduits include respective portions in axial alignment, and wherein said means for opening one of said check valves comprises a member slidable in said portions of said first and second conduits and having opposite ends engaging said check valves.

3. A hydraulic circuit in accordance with claim 2 wherein said first and second check valves include ball members, and wherein said slidable member engages said ball members.

4. A hydraulic circuit in accordance with claim 1 wherein said means for opening one of said check valves in response to closure of the other of said check valves comprises a rocker having opposite first and second ends and being pivotally supported intermediate said first and second ends, a first push rod including a first portion extending into said first conduit and engaging said check valve therein and a second portion engaging said first end of said rocker arm so as to cause pivotal movement of said rocker arm in one rotary direction to open said check valve in said second conduit in response to closure of said check valve in said first conduit, and a second push rod including a first portion extending into said second conduit and engaging said check valve therein and a second portion engaging said second end of said rocker arm so as to cause pivotal movement of said rocker arm in a second rotary direction opposite to said first rotary direction to open said check valve in said first conduit in response to closure of said check valve in said second conduit.

5. A hydraulic circuit for a marine propulsion device including a cylinder/piston assembly including a blind end and a rod end, said circuit comprising a sump for hydraulic fluid, a reversible hydraulic pump including first and second discharge ports, a first fluid conduit communicating between said sump and said first discharge port of said pump and including a one way check valve permitting flow to said pump from said sump and preventing flow to said sump from said pump, and adapted to communicate with said blind end of the hydraulic cylinder/piston assembly, a second fluid conduit communicating between said sump and said second discharge port of said pump and including a one way check valve permitting flow to said pump from said sump and preventing flow to said sump from said pump, and adapted to communicate with the rod end of the cylinder/piston assembly, and means for opening said check valve in one of said fluid conduits in response to closure of said check valve in the other of said fluid conduits.

6. A hydraulic circuit in accordance with claim 5 wherein said first and second conduits include respective portions in axial alignment, and wherein said check valve opening means comprises a member slidable in said portions of said first and second conduits and having opposite ends engaging said check valves.

7. A hydraulic circuit in accordance with claim 6 wherein said first and second check valves include ball members, and wherein said slidable member engages said ball members.

8. A hydraulic circuit in accordance with claim 1 wherein said check valve opening means comprises a rocker having opposite first and second ends and being pivotally supported intermediate said first and second ends, a first push rod including a first portion extending into said first conduit and engaging said check valve therein and a second portion engaging said first end of said rocker arm so as to cause pivotal movement of said rocker arm in one rotary direction to open said check valve in said second conduit in response to closure of said check valve in said first conduit, and a second push rod including a first portion extending into said second conduit and engaging said check valve therein and a second portion engaging said second end of said rocker arm so as to cause pivotal movement of said rocker arm in a second rotary direction opposite to said first rotary direction to open said check valve in said first conduit in response to closure of said check valve in said second conduit.

9. A marine propulsion device comprising a propulsion unit including an engine and a propeller shaft driven by said engine and adapted to support a propeller, means adapted for supporting said propulsion unit and including a first bracket adapted to be mounted on a boat transom, a second bracket connected to said first bracket for tilting movement about a horizontal axis and connected to said Propulsion unit to afford common vertical tilting movement of said propulsion unit with said second bracket, a hydraulic cylinder/piston assembly including a cylinder having a blind end connected to said first bracket and a closed outer end, a piston located in said cylinder, and a piston rod fixed to said piston, extending through said closed end, and adapted to engage said second bracket, means for pressuring said cylinder to trim out and to trim in said propulsion unit and including a hydraulic sump, a reversible hydraulic pump including first and second discharge ports, a first fluid conduit including a first branch connecting said first discharge port of said pump to said closed end of said cylinder and a second branch connecting said first discharge port of said pump to said sump and including a one way check valve for permitting flow to said pump from said sump and for preventing flow from said pump to said sump, a second fluid conduit including a first branch connecting said second discharge port of said pump to said outer end of said cylinder and a second branch connecting said second discharge port of said pump to said sump and including a one way check valve for permitting flow to said pump from said sump and preventing flow to said sump from said pump, and means for opening said check valve in said second branch of one of said conduits in response to closure of said check valve in said second branch of the other of said conduits.

10. A marine propulsion device in accordance with claim 9 wherein said second branches of said first and second conduits include respective portions in axial alignment, and wherein said check valve opening means comprises a member slidable in said portions of said second branches of said first and second conduits and having opposite ends engaging said check valves.

11. A marine propulsion device in accordance with claim 10 wherein said first and second check valves include ball members, and wherein said slidable member engages said ball members.

12. A hydraulic circuit in accordance with claim 9 wherein said check valve opening means comprises a rocker having opposite first and second ends and being pivotally supported intermediate said first and second ends, a first push rod including a first portion extending into said second branch of said first conduit and engaging said check valve therein and a second portion engaging said first end of said rocker arm so as to cause pivotal movement of said rocker arm in one rotary direction to open said check valve in said second branch of said second conduit in response to closure of said check valve in said second branch of said first conduit, and a second push rod including a first portion extending into said second branch of said second conduit and engaging said check valve therein and a second portion engaging said second end of said rocker arm so as to cause pivotal movement of said rocker arm in a second rotary direction opposite to said first rotary direction to open said check valve in said second branch of said first conduit in response to closure of said check valve in said second branch of said second conduit.

* * * * *